US009218730B2

(12) United States Patent
Nguyen

(10) Patent No.: US 9,218,730 B2
(45) Date of Patent: Dec. 22, 2015

(54) SECURITY TAG WITH MAGNETIC GATE

(71) Applicant: Thang T. Nguyen, Boca Raton, FL (US)

(72) Inventor: Thang T. Nguyen, Boca Raton, FL (US)

(73) Assignee: Tyco Fire & Security GmbH, Rheinfall (CH)

( * ) Notice: Subject to any disclaimer, the term of this patent is extended or adjusted under 35 U.S.C. 154(b) by 45 days.

(21) Appl. No.: 14/190,686

(22) Filed: Feb. 26, 2014

(65) Prior Publication Data

US 2015/0243145 A1 Aug. 27, 2015

(51) Int. Cl.

| | |
|---|---|
| ***G08B 13/14*** | (2006.01) |
| ***G08B 13/24*** | (2006.01) |
| ***E05B 73/00*** | (2006.01) |

(52) U.S. Cl.

CPC ..... *G08B 13/2434* (2013.01); *E05B 73/0017* (2013.01); *E05B 73/0052* (2013.01); *E05B 73/0064* (2013.01); *G08B 13/2431* (2013.01)

(58) Field of Classification Search

CPC ..... E05B 39/002; E05B 73/0017; G08B 13/2448

USPC ..... 340/571.1–572.8, 568.1, 586.2; 235/382, 385, 492

See application file for complete search history.

(56) References Cited

U.S. PATENT DOCUMENTS

| | | | | |
|---|---|---|---|---|
| 5,426,419 | A | 6/1995 | Nguyen et al. | |
| 7,347,068 | B2 * | 3/2008 | Seidel | 70/57.1 |
| 7,633,396 | B2 * | 12/2009 | Lynce et al. | 340/572.8 |
| 7,652,574 | B2 * | 1/2010 | Sayegh | 340/568.1 |
| 2004/0172989 | A1 | 9/2004 | Seidel | |
| 2012/0055944 | A1 | 3/2012 | Hesch, Jr. | |
| 2013/0146668 | A1 * | 6/2013 | Chandramowle | E05B 3/0017 235/492 |
| 2015/0061872 | A1 * | 3/2015 | Chandramowle | 340/572.9 |

FOREIGN PATENT DOCUMENTS

WO 0212665 A1 2/2002

* cited by examiner

*Primary Examiner* — Tau T Nguyen

(74) *Attorney, Agent, or Firm* — Robert J. Sacco; Carol E. Thorstad-Forsyth; Fox Rothschild LLP

(57) ABSTRACT

Systems (100) and methods (1300) for selectively preventing an unauthorized detachment of a security tag (100) from an article (114). The methods involve: coupling the security tag to the article by locking a tack assembly (110) to a securement member (206) disposed within a housing (104) of the security tag; guiding an external tool (102) into a channel (500) formed within the security tag for releasing the tack assembly from the securement member; and obstructing the external tool's access to the securement member by biasing a post (602) into a first position in which the post at least partially extends into the channel. A magnetic field may be applied to the security tag so as to transition the post from the first position to a second position in which the external tool's access to the securement member is no longer obstructed by the post.

20 Claims, 11 Drawing Sheets

SECURITY TAG WITH MAGNETIC GATE

FIELD OF THE INVENTION

This document relates generally to security tags and associated detachers. More particularly, this document relates to a security tag and an associated detacher for used in an Electronic Article Surveillance ("EAS") system.

BACKGROUND OF THE INVENTION

A typical EAS system in a retail setting may comprise a monitoring system and at least one security tag or label attached to an article to be protected from unauthorized removal. The monitoring system establishes a surveillance zone in which the presence of security tags and/or labels can be detected. The surveillance zone is usually established at an access point for the controlled area (e.g., adjacent to a retail store entrance and/or exit). If an article enters the surveillance zone with an active security tag and/or label, then an alarm may be triggered to indicate possible unauthorized removal thereof from the controlled area. In contrast, if an article is authorized for removal from the controlled area, then the security tag and/or label thereof can be deactivated and/or detached therefrom. Consequently, the article can be carried through the surveillance zone without being detected by the monitoring system and/or without triggering the alarm.

The security tags may be reusable, and thus include releasable attachment devices for affixing the security tags to the articles. Such attachment devices are further designed to be releasable by authorized personnel only so that unauthorized removal of the security tags from their articles can be avoided. To this end, many attachment devices are made releasable only through the use of an associated special hook or detaching mechanism.

An exemplary security tag employing an attachment device and an associated detacher is described in U.S. Pat. No. 5,426,419 ("the '419 patent"), entitled SECURITY TAG HAVING ARCUATE CHANNEL AND DETACHER APPARATUS FOR SAME and assigned to the same assignee hereof. The security tag of the '419 patent includes a tag body and an attachment element or device in the form of a tack assembly. The tack assembly is used to attach the tag body to an article which is to be protected by the security tag. This is accomplished by inserting a tack into an opening in the tag body. When the tack is fully inserted into the opening, it is releasably secured in the tag body via a releasable locking means. Access to the releasable locking means is through an arcuate channel. With this configuration, a special arcuate probe is needed to reach and release the releasable locking means, and thus detach the security tag from the article.

Despite the advantages of this security tag architecture, if suffers from certain drawbacks. For example, the security tag can be defeated by inserting a counterfeit hook or detaching mechanism (e.g., a steel wire) into the arcuate channel so as to release the locking means.

SUMMARY OF THE INVENTION

The present invention concerns implementing systems and methods for selectively preventing an unauthorized detachment of a security tag from an article. The methods involve: coupling the security tag to the article by locking a tack assembly to a securement member disposed within a housing of the security tag; guiding an external tool into a channel formed within the security tag for releasing the tack assembly from the securement member; and obstructing the external tool's access to the securement member by biasing a post into a first position in which the post at least partially extends into the channel. A magnetic field can be applied to the security tag so as to transition the post from the first position to a second position in which the external tool's access to the securement member is no longer obstructed by the post.

In some scenarios, the post is biased into the first position using a resilient member disposed adjacent thereto within the housing of the security tag. The magnetic field may cause compression of the resilient member, whereby the post transitions from the first position to the second position. Thereafter, the securement member can be moved by the external tool so as to release the tack assembly from the securement member. More particularly, the securement member can be rotatably moved by the external tool so as to release the tack assembly from a clamp of the securement member. Once the tack assembly has been released, the external tool is withdrawn from the channel. Next, the magnetic field is no longer applied to the resilient member. In effect, the post is caused to return to the first position.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
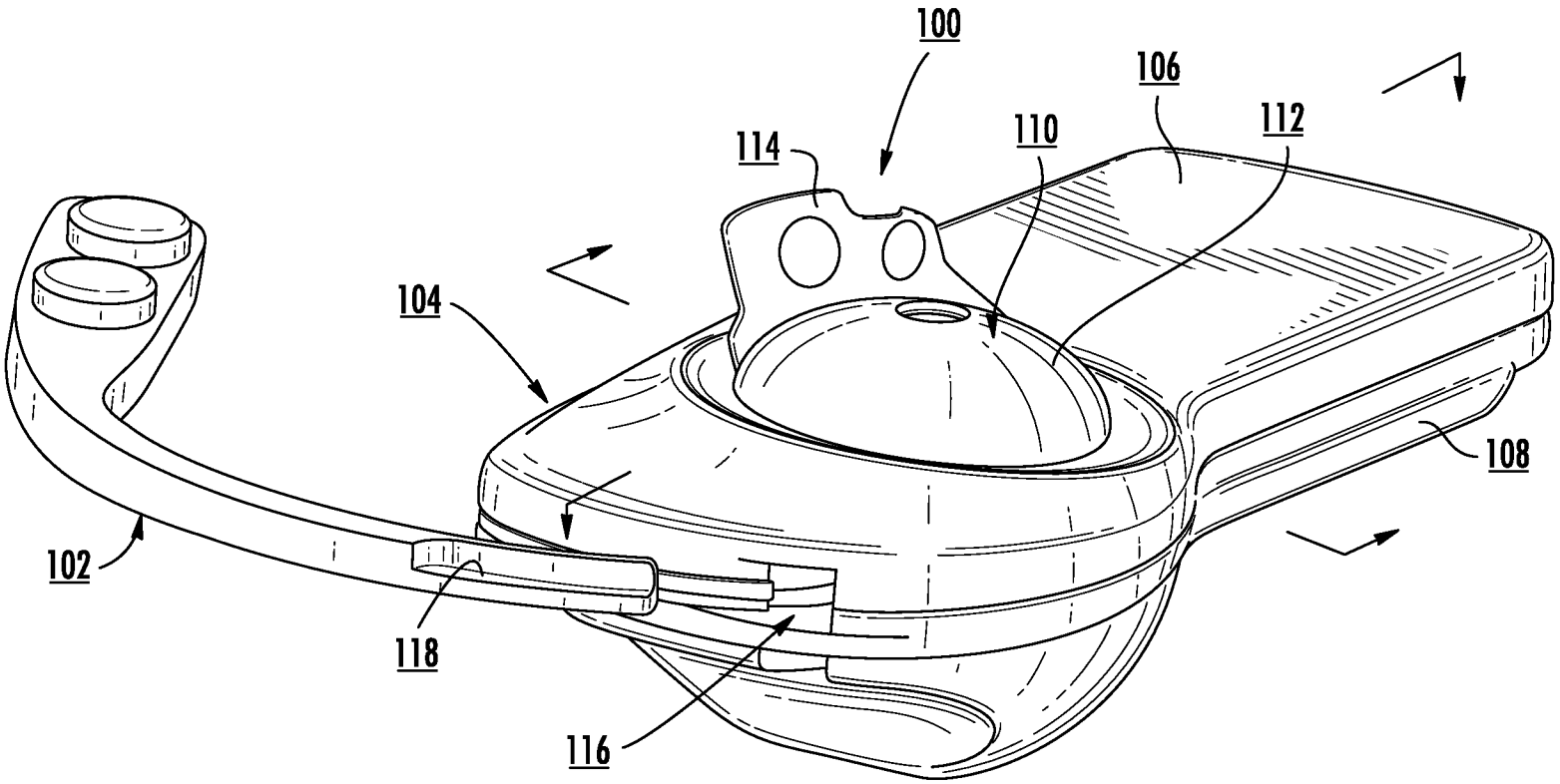
FIG. 1 is a perspective view of an exemplary security tag and detachment mechanism that is useful for understanding the present invention.
Figure 2:
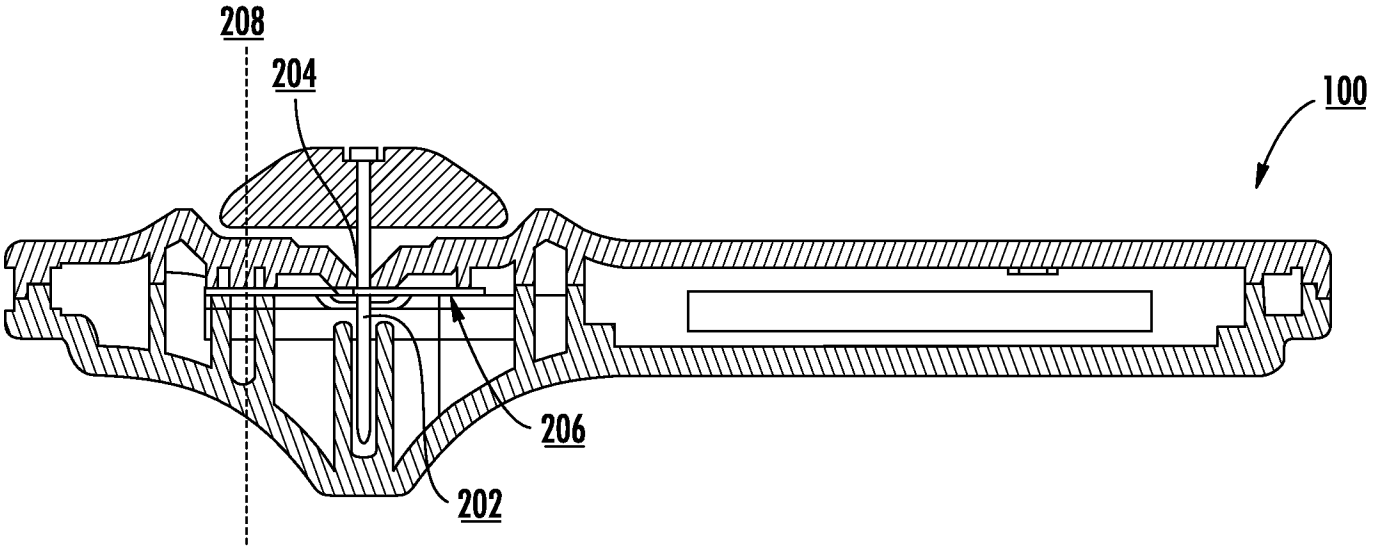
FIG. 2 is a cross sectional side view of the exemplary security tag shown in FIG. 1 that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments of the present invention will now be described with respect to FIGS. 1-13. The present invention generally relates to novel systems and methods for reducing defeat of security tags using counterfeit hooks or detachment mechanisms. In this regard, a gate structure is provided in an arcuate channel of a tag body so as to prevent counterfeit hooks from decoupling a security tag from an article without using an authorized detacher (or external tool). An exemplary embodiment of a conventional authorized detacher is provided in U.S. Pat. No. 5,426,419 ("the '419 patent"), which is incorporated herein by reference. The detacher of the present invention is similar to that of the '419 patent with some additions made thereto (e.g., the addition of a magnet for controlling a position of the gate structure). The particularities of the novel gate structure and detacher will become more evident as the discussion progresses.

Notably, the security tags and detachers (or external tools) of the present invention can be used in a variety of applications. For example, the present invention can be used in an EAS system for detecting the unauthorized removal of articles from a particular area or space. EAS systems are well known in the art, and therefore will not be described herein.

Referring now to FIGS. 1-6, there is provided schematic illustrations useful for understanding an exemplary security tag 100 in accordance with the present invention. As shown in FIGS. 1-6, the security tag 100 includes a housing 104 with an upper housing member 106 joined to a lower housing member 108. The housing members 106, 108 can be joined together via an adhesive, a mechanical coupling means (e.g., snaps, screws, etc.), or a weld (e.g., an ultrasonic weld). The housing 104 can be made from a rigid or semi-rigid material, such as plastic. The housing 104 has an opening 204 formed therein such that at least a portion of a tack assembly 110 (or attachment element) can be inserted into the security tag for facilitating the attachment of the security tag to an article 114 (e.g., a piece of clothing). EAS and/or Radio Frequency Identification ("RFID") components are contained within the housing 104. EAS and RFID components of security tags are well known in the art, and therefore will not be described herein.

Tack assembly 110 has a tack head 112 and an elongate tack body 202 extending down and away from the tack head. The tack body 202 is sized and shaped for insertion into opening 204 and removal from opening 204. A plurality of grooves 406 may be formed along a length of the tack body 202 for engagement with a securement mechanism 206 disposed within the housing 104. When the grooves 406 are engaged by the securement mechanism 206, the security tag 100 is secured to the article 114. Thereafter, unauthorized removal of the article 114 from a controlled area can be detected by a monitoring device of an EAS system. Such monitoring devices are well known in the art, and therefore will not be described herein. Still, it should be understood that at least one sensor (not shown in FIGS. 1-4) is disposed within the housing 104. The sensor includes, but is not limited to, an acoustically resonant magnetic sensor. In all cases, the sensor generates signals which can be detected by the monitoring device.

Such detection occurs when the security tag is present within a surveillance zone established by the monitoring device. The surveillance zone is usually established at an access point for the controlled area (e.g., adjacent to a retail store entrance and/or exit). If the article 114 enters the surveillance zone with the security tag 100, then an alarm may be triggered to indicate possible unauthorized removal thereof from the controlled area. In contrast, if the article 114 is authorized for removal from the controlled area, then the security tag 100 thereof can be deactivated and/or detached therefrom using a detachment mechanism 102 (or external tool). Consequently, the article 114 can be carried through the surveillance zone without being detected by the monitoring system and/or without triggering the alarm.

The detachment mechanism 102 is sized and shaped to at least be partially slidingly inserted into and removed from an insert space 116 formed in the housing 104. When inserted into insert space 116, the detachment mechanism 102 travels through an arcuate channel 500 so as to be guided towards the securement mechanism 206. In this regard, the detachment mechanism 102 has a generally arcuate shape matching that of the arcuate channel 500. Upon engagement with the securement mechanism 206, the detachment mechanism 102 releases the tack body 202 therefrom. Next, the tack body 202 can be removed from the housing, so as to decouple the security tag 100 from the article 114.

Figure 3:
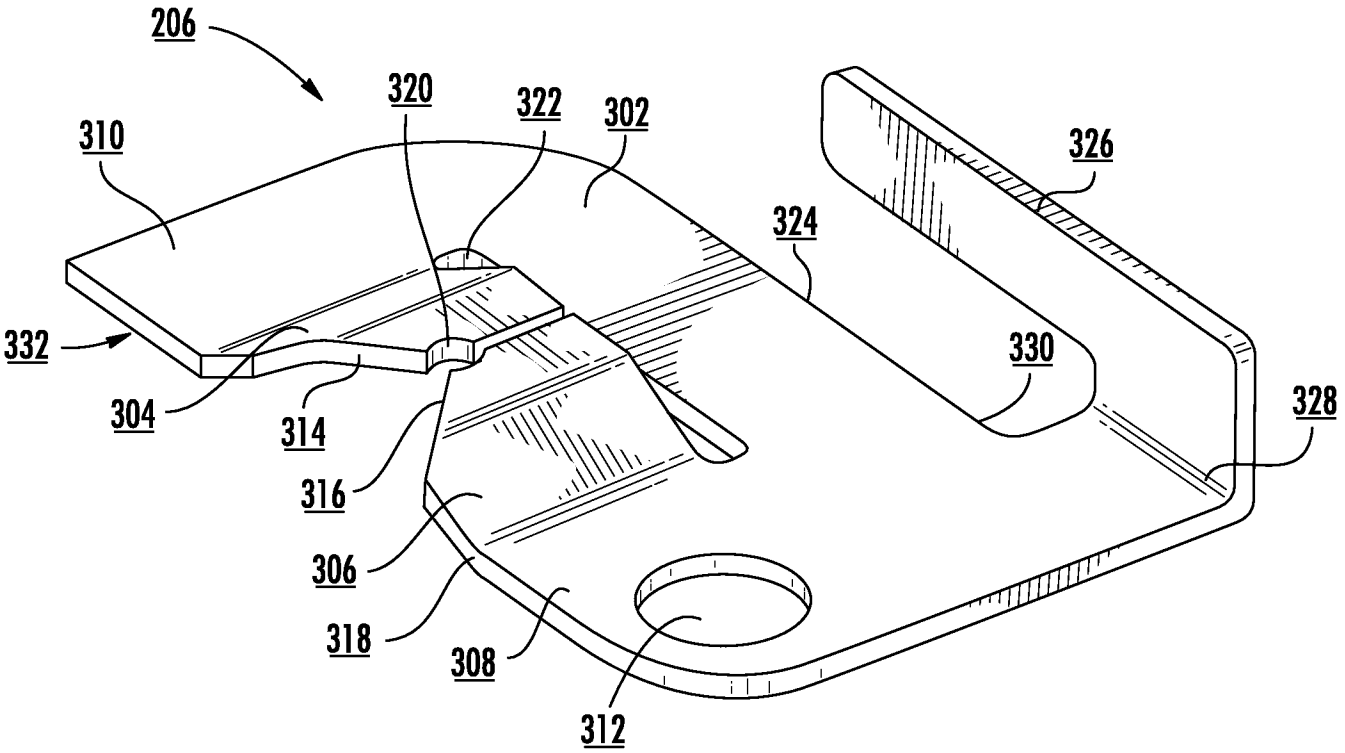
FIG. 3 is a perspective view of a securement mechanism of the security tag shown in FIG. 1.
Figure 4:
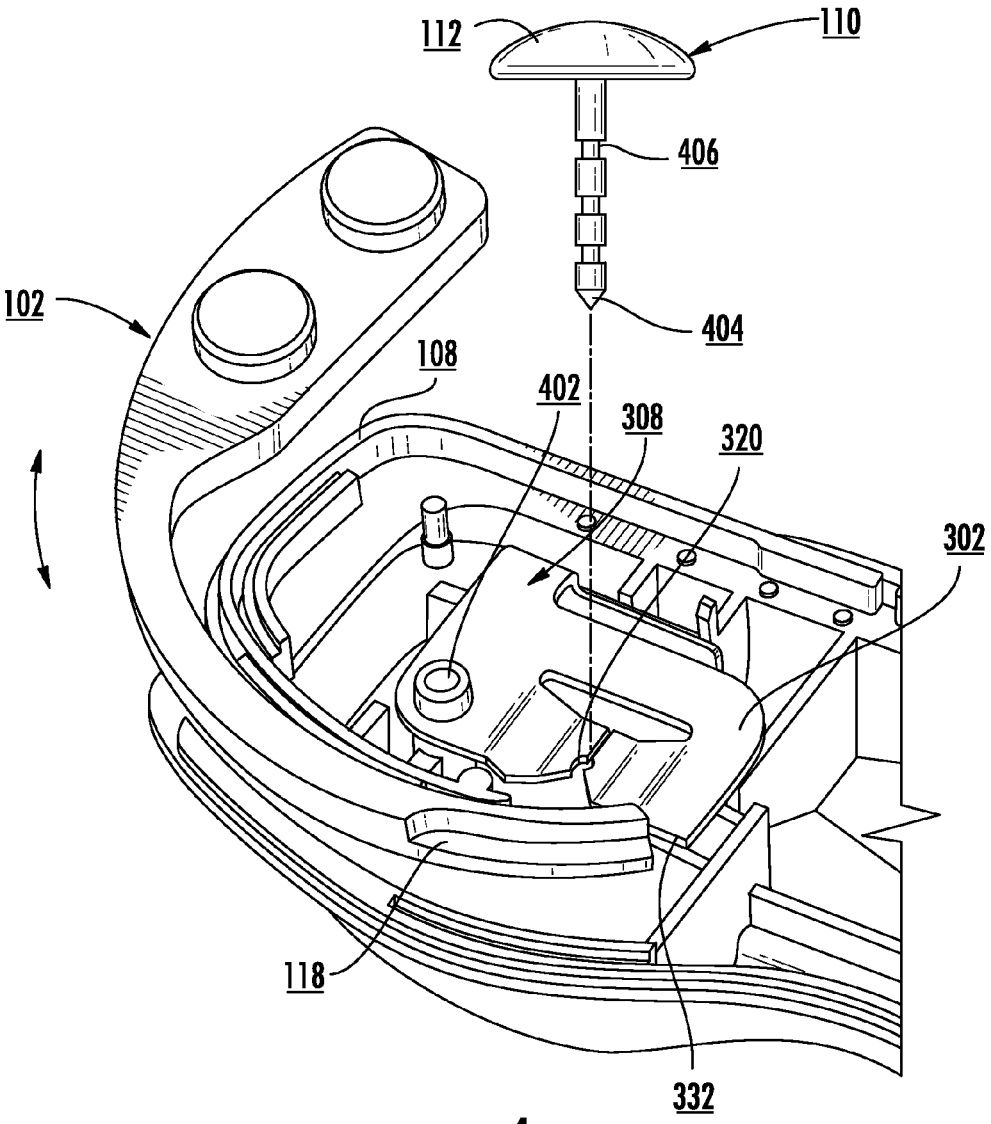
FIG. 4 is a top perspective view of a bottom portion of the exemplary security tag shown in FIG. 1.
Figure 5:
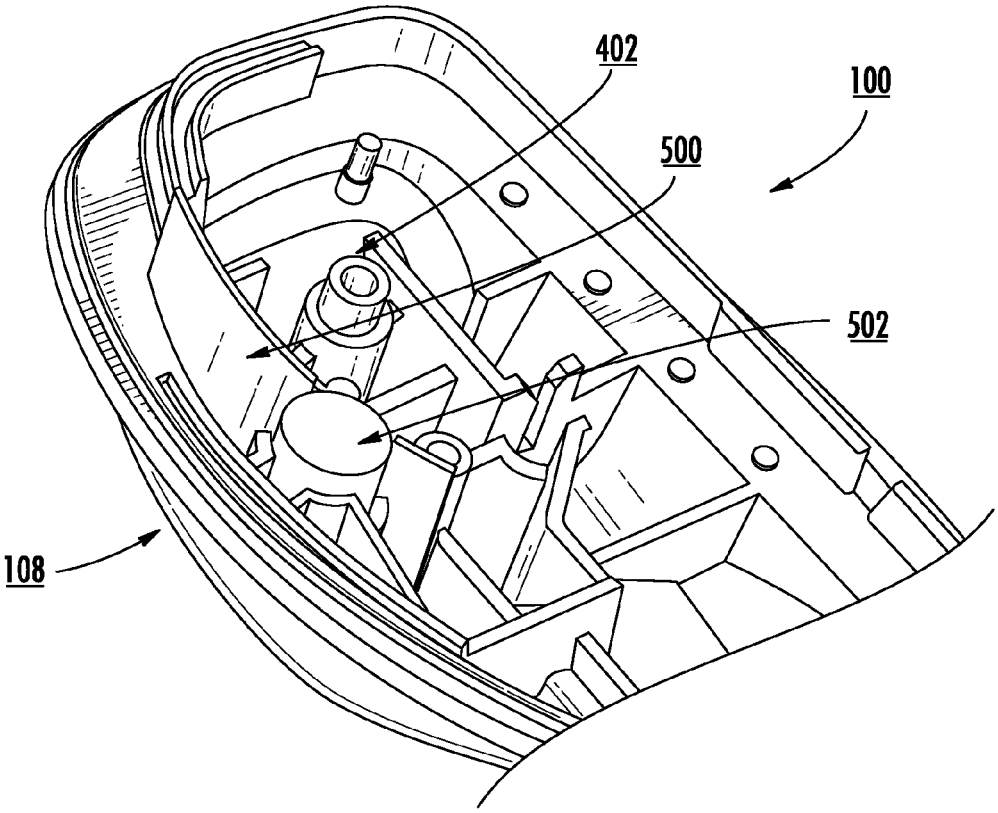
FIGS. 5-6 provide schematic illustrations that are useful for understanding a gate structure of the exemplary security tag shown in FIG. 1.
Figure 6:
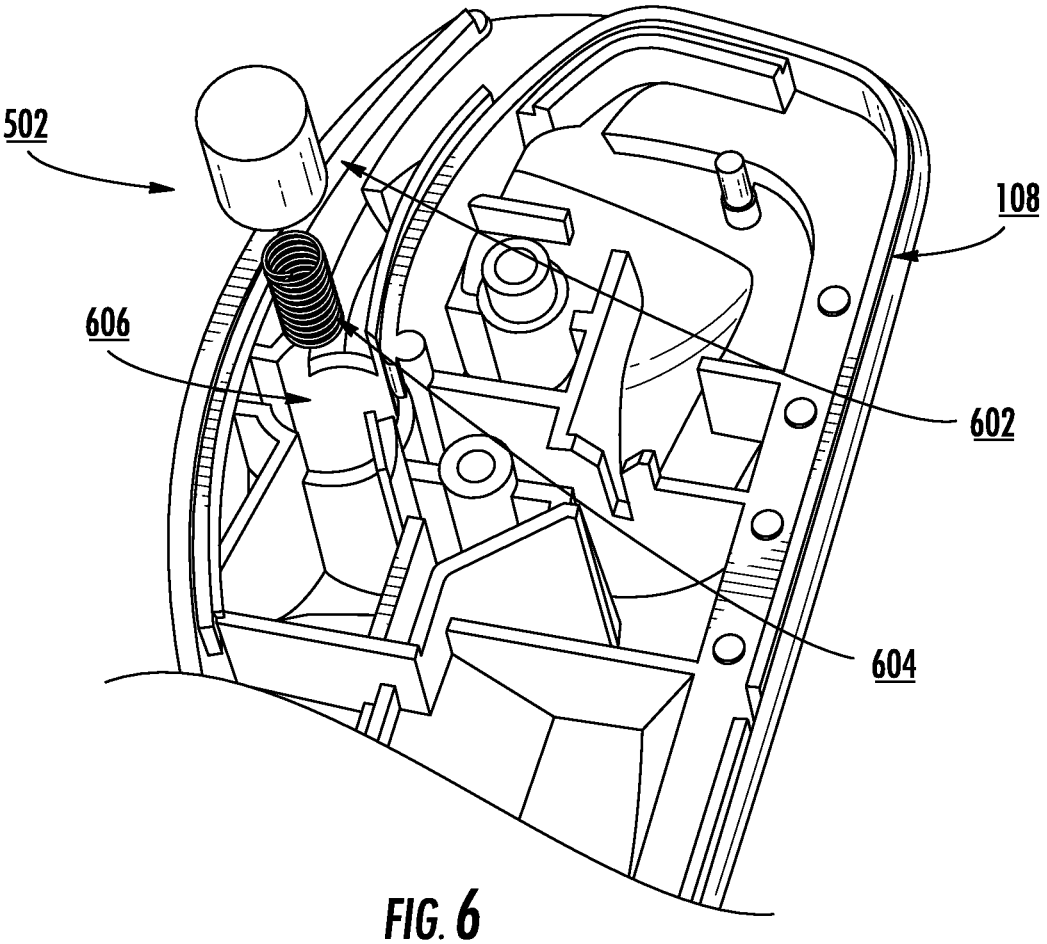

A schematic illustration of the securement mechanism 206 is provided in FIG. 3. As noted above, the securement mechanism 206 is specifically adapted to accommodate release of the tack body 202 via the detachment mechanism 102 (or arcuate probe) moving in the arcuate channel 500. The securement mechanism 206 is generally in the form of a spring clamp securely disposed with the housing 104 of the security tag so as to be pivotable (or rotatable) about an axis 208. In this regard, the spring clamp comprises a clamp body 302 and jaws 304, 306. The clamp body 302 includes a mounting part 308 extending laterally of jaw 306 and a release part 310 extending laterally of jaw 304. The mounting part 308 includes a mounting aperture 312 facilitating the pivotable movement of the securement mechanism 206 within the housing of the security tag. The pivotable movement allows the securement mechanism 206 to be transitioned by the detachment mechanism 102 (or arcuate probe) from a first position in which the tack assembly is locked thereto and a second position in which the tack assembly is released or unlocked therefrom.

Each of the jaws 304, 306 extends outwardly of the plane of the clamp body 302 and then inwardly toward the other jaw. The jaws 304, 306 terminate in facing edges 314, 316. These edges extend from a common edge 318 of the clamp body 302 inwardly toward each other, then curve outwardly away from each other to define an aperture 320 (typically, circular or elliptical) for receiving the tack body 202. The edges 314, 316 then continue in aligned fashion and end in an elongated, lateral slot 322 in the clamp body 302. The lateral slot lies inward of a further clamp body edge 324 which opposed the clamp body edge 318.

A further laterally extending elongated spring sleeve 326 is attached by a joint area 328 to the side 330 of the edge 324 bordering the mounting part 308. The sleeve 326 extends along the length of the edge 324 and is also out of the plane of the clamp body 302.

For mounting and supporting the spring clamp 302, the lower housing member 108 of the security tag 100 includes a circular mount 402. The spring clamp 302 is mounted, via aperture 312 of the mounting part 308, on the circular mount 402. In this way, the mounting part 308 can be rotated about the circular mount 402. The spring clamp 302 is thus able to pivot about the mounting part 308 as will be described more fully below.

When an end 404 of the tack assembly 110 is introduced in the downward direction through the opening 204 in the upper housing member 106, the tack body 204 is directed to aperture 320 of the securement mechanism 206. This causes the jaws 304, 306 to spread open and allow the tack body 204 to pass there through.

When the downward movement of the tack assembly 110 is stopped, the jaws 304, 306 retract and clutch the tack body 204. In this position, the jaws 304, 306 prevent upward movement of the tack assembly 110. As such, the security tag 100 becomes securely coupled to the article 114.

In order to release the tack body 204 from the jaws 304-306, the detachment mechanism 102 is introduced into the insert space 116 formed in the housing 104 of the security tag 100. Rotation of the detachment mechanism 102 causes it to be moved in and guided by the arcuate channel 500 until the end 118 abuts portion 332 of the securement mechanism 206. Continued rotational movement of the detachment mechanism 102 causes force to be applied to portion 332 of the securement mechanism 206. This force, in turn, causes the clamp body 302 to rotate about the support area 308. The jaw 304 is thus enabled to spread away from jaw 306 due to the force of the tack body 204, which is being held stationary by jaw 306. As a result, aperture 320 expands, releasing the tack body 204 from the clutch of the jaws. The tack assembly 110 can now be moved in the upward direction past the jaws, via an upward force on the tack head 112.

During rotation of the clamp body 302, the spring sleeve 326 at the joint area 328 is compressed. After the tack assembly 110 is separated from the housing 104, the detachment mechanism 102 is rotated in the reverse direction. This reverse rotation disengages the detachment mechanism 102 from the securement mechanism 206. Consequently, the spring sleeve 326 rotates in an opposite direction so as to be brought back to its original position. Thereafter, the detachment mechanism 102 is guided out of the arcuate channel 500 and is removed from insert space 116 formed in the housing 104.

Notably, a gate structure 502 is provided within the housing 104 for preventing counterfeit hooks from accessing the securement mechanism 206 without using an authorized detacher. As shown in FIGS. 5-9, the gate structure 502 comprises a post 602 disposed in a channel 606 formed in the lower housing member 108. In a first position shown in FIGS. 5 and 7-8, the post 602 at least partially extends out and away from the channel 606. Within the channel 606 and beneath the post 602 resides a spring 604. The post 602 and spring 604 are movable within channel 606 in an upward direction 704 and a downward direction 706. Post 602 can be made from a variety of materials, including ferrous and non-ferrous materials.

The spring 604 is normally biased to press upon a bottom surface 702 of the post 602, thereby forcing the post 602 into its first position. While the post 602 is in its first or engaged position, the post 602 obstructs access to the securement mechanism 206 via the arcuate channel 500. In this regard, the post 602 extends into the arcuate channel 500 such that the detachment mechanism 102 can only travel a certain distance into the security tag 100, which is less than the entire length of the arcuate channel 500. Stated differently, the post 602 inhibits access to the securement mechanism 206 by an external tool. As such, mere insertion of a detachment mechanism 102 into the arcuate channel 500 will not result in the rotation of the securement mechanism 206 so as to release the tack body 204 from the clutch of the jaws 304, 306.

Figure 7:
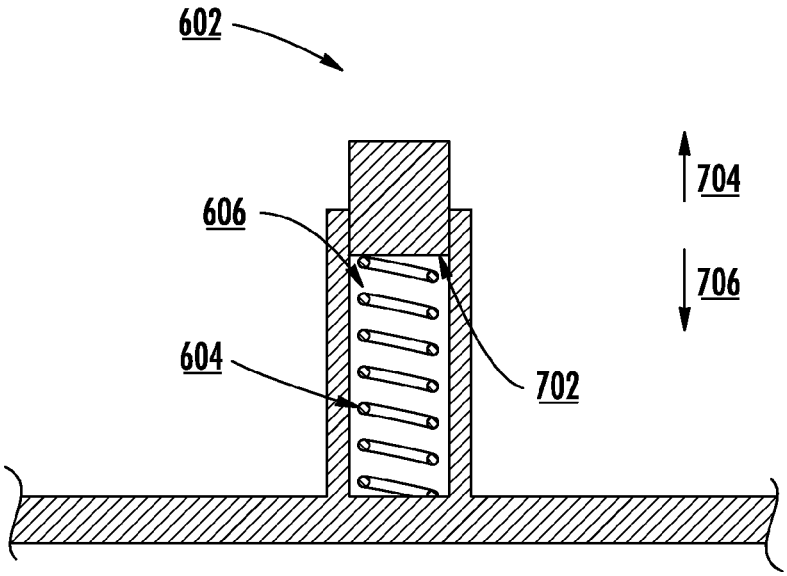
FIGS. 7-10 provide schematic illustrations that collectively show operations of the gate structure shown in FIGS. 5-6.
Figure 8:
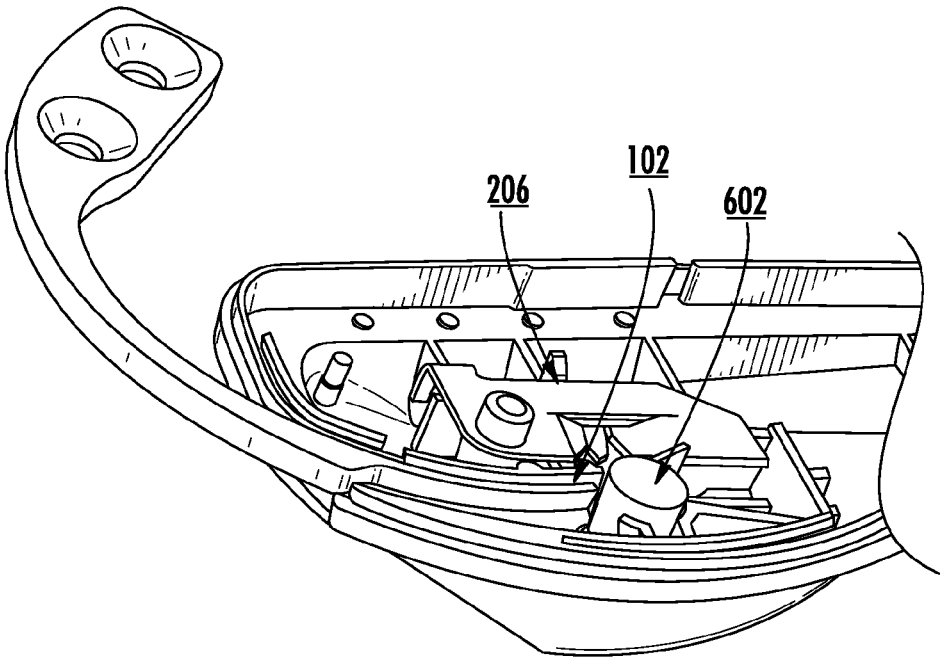
Figure 9:
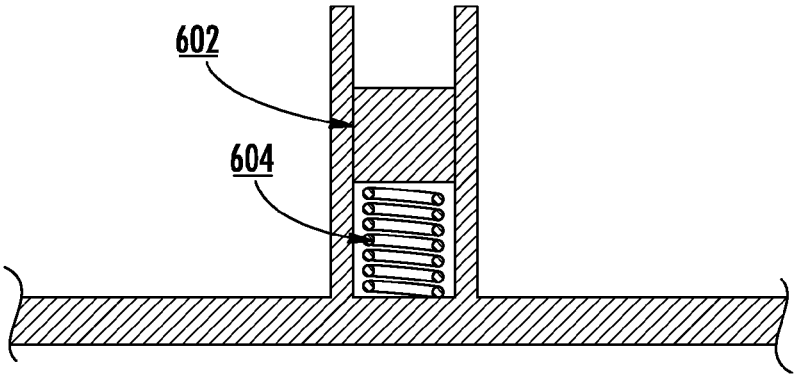
Figure 10:
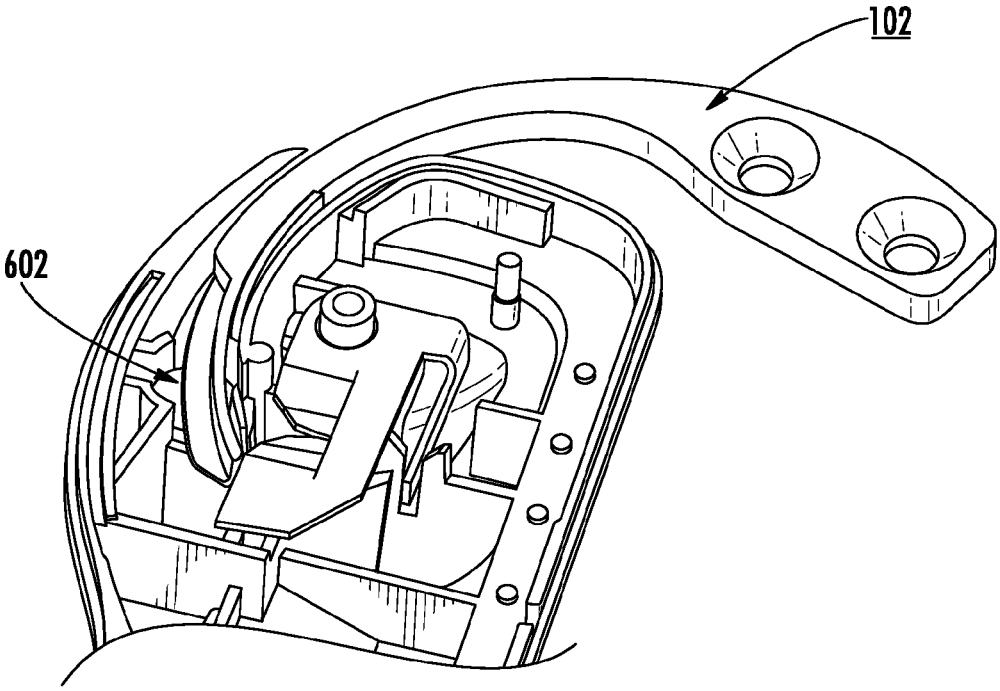

When the security tag 100 is brought to a Point Of Sale ("POS") station of an EAS system, post 602 can be retracted into the channel 606 using an authorized detacher, thus transitioning from its first position shown in FIGS. 7-8 into its second or unengaged position shown in FIGS. 9-10. POS stations and EAS systems are well known in the art, and therefore will not be described herein. In some scenario, the post 602 is transitioned to its second position by placing a magnet therebelow so as to cause compression of the spring 604. While the post 602 is in its second position, the detachment mechanism 102 can access the securement mechanism 206, as described above, for releasing the tack body 204 from the clutch of the jaws 304, 306. In effect, the security tag 100 can be safely removed from its article 114.

Figure 11:
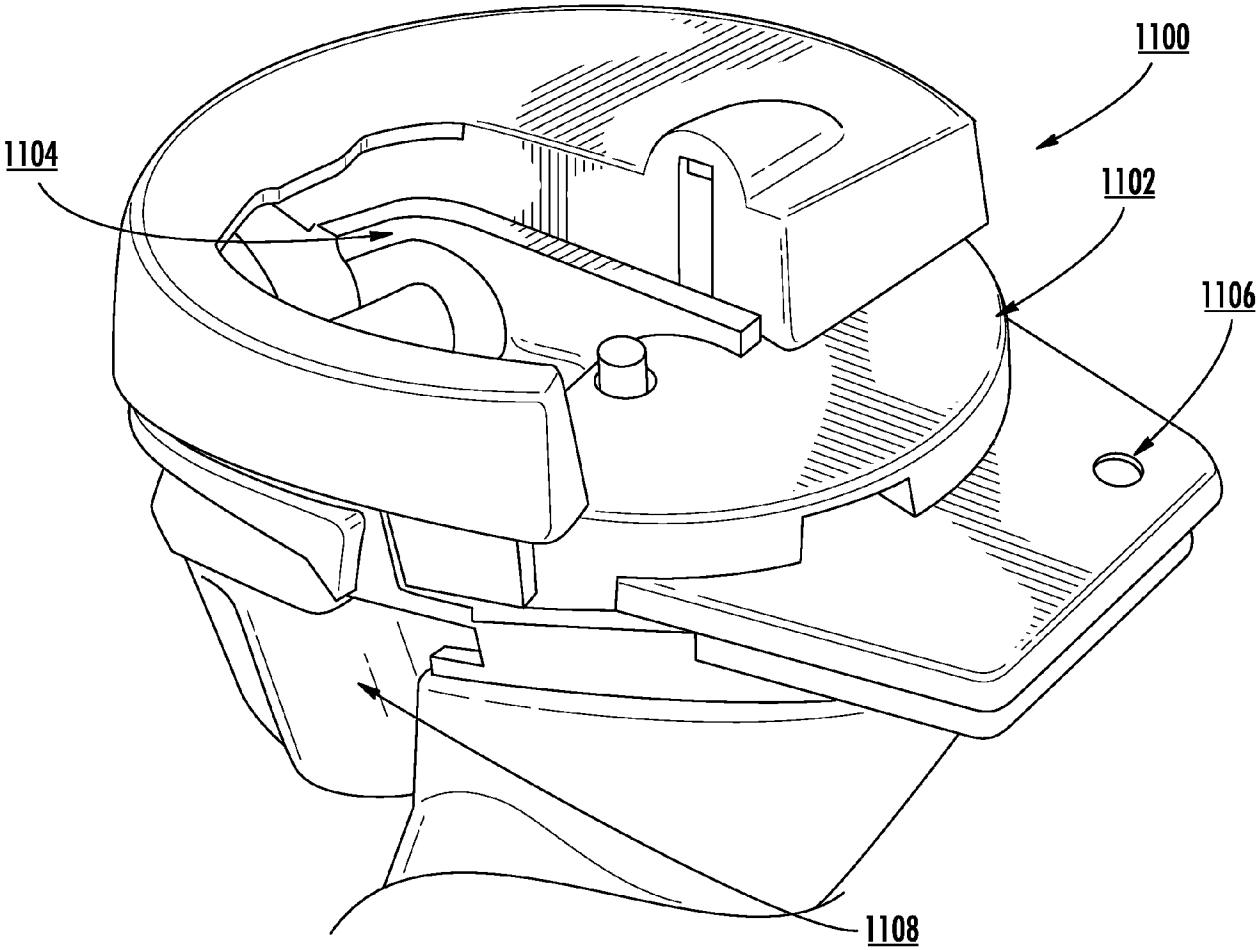
FIG. 11 is a top perspective view of an exemplary detacher that is useful for understanding the present invention.
Figure 12:
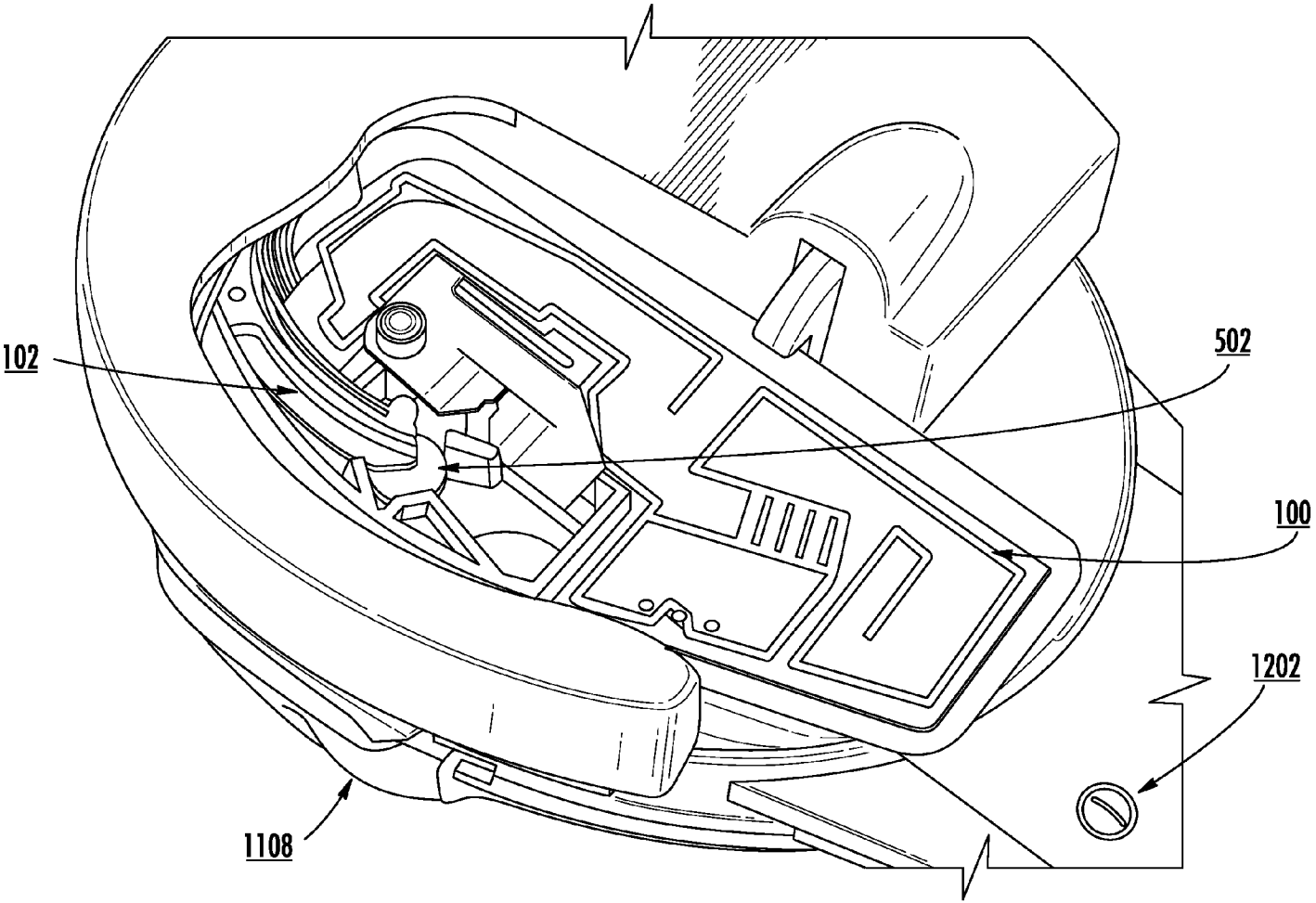
FIG. 12 is a schematic illustration that is useful for understanding how the detacher operates for detaching the security tag of FIG. 1 from an article.

Referring now to FIGS. 11-12, there is provided schematic illustrations that are useful for understanding operations of an authorized detacher 1100 for detaching a security tag 100 from an article 114. More particularly, FIG. 11 is a top perspective view of an exemplary detacher 1100. FIG. 12 is a schematic illustration of a security tag disposed within a cradle area of the detacher 1100. Notably, the upper housing member 106 of the security tag 100 is omitted from FIG. 12.

The detacher 1100 incorporates the arcuate detachment mechanism 102. The detacher 1100 is a manual actuated assembly and/or a power actuated assembly for detaching a security tag 100 from an article 114. Manual actuated assemblies are well known in the art, and therefore will not be described herein. In some power actuated assemblies, the detacher 1100 comprises an electronic circuit that is supplied power from an external power source and/or an internal power source (e.g., a battery). The electronic circuit and/or internal power source are contained within a housing 1102. An exposed ON/OFF switch 1202 is provided for turning the detacher 1100 on and off. At least one indicator 1106 (e.g., a light emitting diode) is provided for indicating an on/off status of the detacher 1100.

The housing 1102 includes a nesting or cradle area 1104 for receiving the security tag 100. When the security tag 100 is inserted into the cradle area 1104, a magnet 1108 of the detacher 1100 actuates the spring 604 of the gate structure 502. In turn, the spring 604 compresses thereby causing the post 602 to be transitioned from its first position shown in FIGS. 7-8 to its second position shown in FIGS. 9-10.

Thereafter, in the manual and/or power actuated scenarios, the detacher 1100 performs electrical and/or mechanical operations for rotating the detachment mechanism 102 in a counter clockwise direction. Electrical and mechanical means for causing rotation of the detachment mechanism 102 are well known in the art, and therefore will not be described in detail herein. Still, it should be understood that in some power actuated scenarios, the detacher 1100 comprises at least one switch (not shown). This switch provides signals over lines (not shown) to control the electronic circuit internal to the housing 1102, which may be mounted on a printed circuit board (not shown). The electrical circuit, in turn, provides drive signals to a drive motor (not shown) for driving the same so as to realize movement of the detachment mechanism 102.

As a result of said rotation, the detachment mechanism 102 is introduced into the insert space 116 formed in the housing 104 of the security tag 100. Rotation of the detachment mechanism 102 causes it to be moved in and guided by the arcuate channel 500 until the end 118 abuts portion 332 of the securement mechanism 206. Continued rotational movement of the detachment mechanism 102 causes force to be applied to portion 332 of the securement mechanism 206. This force, in turn, causes the clamp body 302 to rotate about the support area 308. The jaw 304 is thus enabled to spread away from jaw 306 due to the force of the tack body 204, which is being held stationary by jaw 306. As a result, aperture 320 expands, releasing the tack body 204 from the clutch of the jaws. The tack assembly 110 can now be moved in the upward direction past the jaws, via an upward force on the tack head 112.

After the tack assembly 110 is separated from the housing 104, the detachment mechanism 102 is rotated in the reverse direction. This reverse rotation disengages the detachment mechanism 102 from the securement mechanism 206. Consequently, the spring sleeve 326 rotates in an opposite direction so as to be brought back to its original position. Thereafter, the detachment mechanism 102 is guided out of the arcuate channel 500 and is removed from insert space 116 formed in the housing 104.

When the security tag 100 is removed from the cradle area 1104 of the manual or power actuated detacher 1100, the magnetic field applied to the spring 604 of the gate structure 502 is removed therefrom. Consequently, the gate structure 502 returns to its first position in which the post 602 thereof obstructs access to the securement mechanism 206 via the arcuate channel 500.

Figure 13:
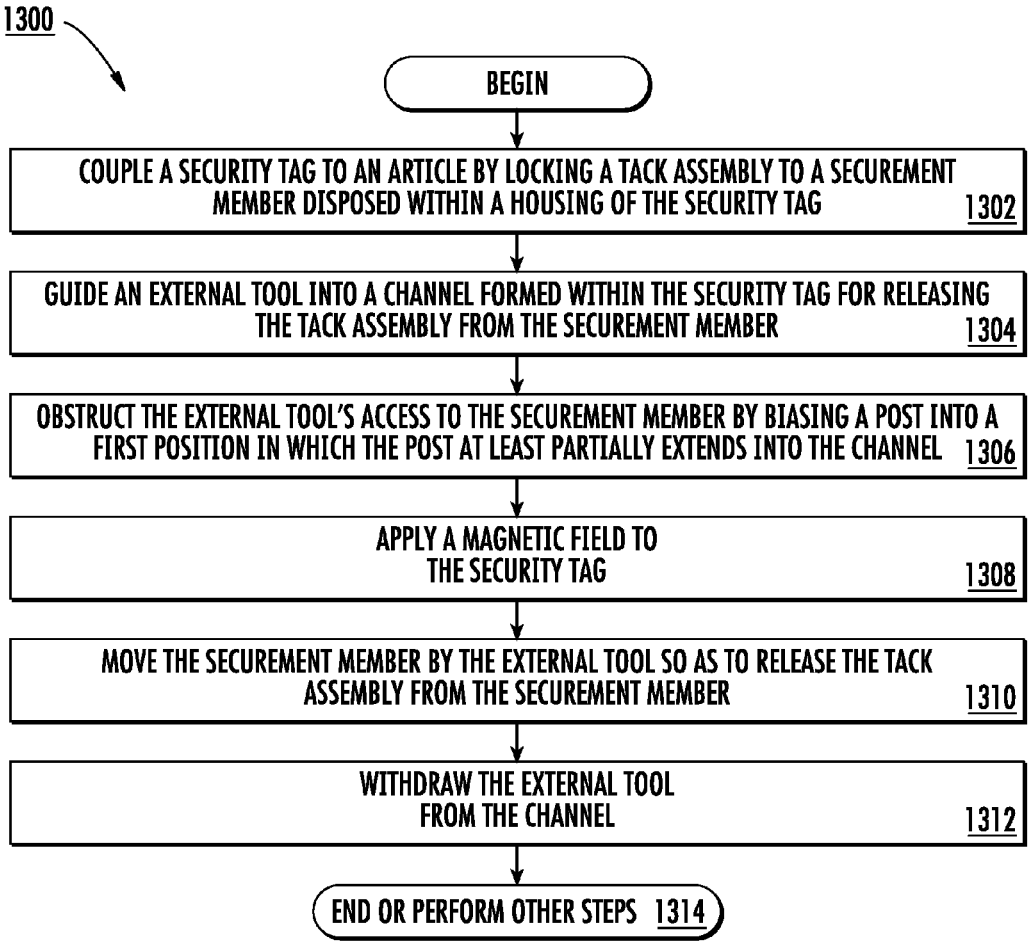
FIG. 13 is a flow diagram of an exemplary method for preventing an unauthorized detachment of a security tag from an article.

FIG. 13 is a flow diagram of an exemplary method 1300 for preventing an unauthorized detachment of a security tag (e.g., security tag 100 of FIG. 1) from an article (e.g., article 114 of FIG. 1). The method 1300 begins with step 1302 and continues with step 1304. In step 1304, the security tag is coupled to the article by locking a tack assembly (e.g., tack assembly 110 of FIG. 1) to a securement member (e.g., securement member 206 of FIG. 2) disposed within a housing (e.g., housing 104 of FIG. 1) of the security tag. Next in step 1306, an external tool (e.g., tool 102 of FIG. 1) is guided into a channel (e.g., channel 500 of FIG. 5) formed within the security tag for releasing the tack assembly from the securement member. Notably in step 1306, the external tool's access to the securement member is obstructed. This obstruction is achieved by biasing a post (e.g., post 602 of FIG. 6) into a first position in which the post at least partially extends into the channel. The post can be biased into the first position using a resilient member (e.g., spring 604 of FIG. 6) disposed adjacent to the post within the housing of the security tag.

At some time later, a magnetic field is applied to the security tag, as shown by step 1308. As a result, the post transitions from the first position to a second position in which the external tool's access to the securement member is no longer obstructed by the post. In some scenarios, the magnetic field causes compression of a resilient member disposed within the housing of the security tag adjacent to the post. Compression of the resilient member, in turn, causes the post to transition from the first position to the second position.

Once the resilient member transitions into its second position, the securement member can be moved by the external tool so as to release the tack assembly therefrom, as shown by step 1310. In some scenario, the securement member is rotatably moved by the external tool so as to release the tack assembly from a clamp of the securement member. Subsequently, the external tool is withdrawn from the channel, as shown by step 1312. In a next step 1314, method 1300 ends or other steps is performed.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

I claim:

1. A method for selectively preventing an unauthorized detachment of a security tag from an article, comprising:

coupling the security tag to the article by locking a tack assembly to a securement member disposed within a housing of the security tag;

guiding an external tool into a channel formed within the security tag for releasing the tack assembly from the securement member; and obstructing the external tool's access to the securement member by biasing a post into a first position in which the post at least partially extends into the channel.

2. The method according to claim 1, wherein the post is biased into the first position using a resilient member disposed adjacent to the post within the housing of the security tag.

3. The method according to claim 1, further comprising applying a magnetic field to the security tag so as to transition the post from the first position to a second position in which the external tool's access to the securement member is no longer obstructed by the post.

4. The method according to claim 3, wherein the magnetic field causes compression of a resilient member disposed within the housing of the security tag adjacent to the post, whereby the post transitions from the first position to the second position.

5. The method according to claim 4, further comprising moving the securement member by the external tool so as to release the tack assembly from the securement member.

6. The method according to claim 4, further comprising rotatably moving the securement member by the external tool so as to release the tack assembly from a clamp of the securement member.

7. The method according to claim 3, further comprising withdrawing the external tool from the channel.

8. The method according to claim 7, further comprising removing application of the magnetic field from the resilient member so as to cause the post to return to the first position.

9. The method according to claim 1, wherein the channel is an arcuate channel and the external tool comprises an arcuate probe.

10. A security tag, comprising:

a housing;

a securement member disposed within the housing and configured to releasably lock a tack assembly thereto;

a channel formed within the housing and configured to guide an external tool through the security tag towards the securement member; and a post biased into a first position in which the post at least partially extends into the channel so as to obstruct the external tool's access to the securement member for releasing the tack assembly therefrom.

11. The security tag according to claim 10, further comprising a resilient member disposed adjacent to the post within the housing and biasing the post into the first position.

12. The security tag according to claim 10, wherein a magnetic field applied to the security tag causes the post to transition from the first position to a second position in which the external tool's access to the securement member is no longer obstructed by the post.

13. The security tag according to claim 12, wherein the magnetic field causes compression of a resilient member disposed within the housing of the security tag adjacent to the post, whereby the post transitions from the first position to the second position.

14. The security tag according to claim 13, wherein the tack assembly is released from the securement member by moving the securement member by the external tool.

15. The security tag according to claim 13, wherein the tack assembly is released from a clamp of the securement member by rotably moving the securement member by the external tool.

16. The security tag according to claim 13, wherein the post returns to the first position when (1) the external tool is withdrawn from the channel and (2) application of the magnetic field is removed from the resilient member.

17. The security tag according to claim 10, wherein the channel is an arcuate channel and the external tool comprises an arcuate probe.

18. A security tag, comprising:

a housing;

a clamp securely disposed within the housing such that the clamp is pivotable about a first axis and movable by an external tool between a first position in which an attachment element is releasably locked to the clamp and a second position in which the attachment element is unlocked from the clamp; and a gate structure disposed with a channel formed in the housing adjacent to the clamp and configured to selectively obstruct access to the clamp by an external tool.

19. The security tag according to claim 18, wherein the gate structure comprises a post movable into and out of the channel so as to selectively obstruct the external tool's access to the clamp.

20. The security tag according to claim 19, wherein the gate structure further comprises a resilient member is configured to bias the post into a first position in which the post extends into the channel and transition the post from the first position to a second position in which the clamp is accessible to the external device when a magnetic field is applied thereto.

* * * * *